US009140449B2

(12) United States Patent
Böttcher et al.

(10) Patent No.: US 9,140,449 B2
(45) Date of Patent: Sep. 22, 2015

(54) BURNING ELEMENT AND BURNER WITH A CORROSION-RESISTANT INSERT

(75) Inventors: Andreas Böttcher, Mettmann (DE); Thomas Kunadt, Essen (DE); Elmar Pfeiffer, Heinsberg (DE); Ulrich Wörz, Orlando, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 1120 days.

(21) Appl. No.: 12/867,513

(22) PCT Filed: Feb. 9, 2009

(86) PCT No.: PCT/EP2009/051432
§ 371 (c)(1),
(2), (4) Date: Jan. 7, 2011

(87) PCT Pub. No.: WO2009/101043
PCT Pub. Date: Aug. 20, 2009

(65) Prior Publication Data

US 2011/0104626 A1 May 5, 2011

(30) Foreign Application Priority Data

Feb. 14, 2008 (EP) ..... 08002769

(51) Int. Cl.
*F23D 11/36* (2006.01)
*F23M 5/02* (2006.01)
*F23R 3/28* (2006.01)
(Continued)

(52) U.S. Cl.
CPC ..... *F23D 11/36* (2013.01); *F23M 5/025* (2013.01); *F23R 3/283* (2013.01); *F01D 25/007* (2013.01); *F02M 2200/05* (2013.01); *F23C 5/02* (2013.01); *F23D 2213/00* (2013.01); *F23D 2900/00018* (2013.01)

(58) Field of Classification Search
CPC ..... F05D 2300/177; F02C 7/30
USPC ..... 60/800, 737–748
See application file for complete search history.

(56) References Cited

U.S. PATENT DOCUMENTS 3,122,195 A * 2/1964 Kimmel et al. ..... 431/80
3,132,970 A * 5/1964 Lagreid ..... 136/205
3,409,000 A * 11/1968 Brader et al. ..... 126/59.5
(Continued)

FOREIGN PATENT DOCUMENTS

DE 102004037620 A1 2/2006
EP 0838633 A1 4/1998
(Continued)

OTHER PUBLICATIONS

DRMS Metals USA Alloy 617 Spec Sheet from www.drmsmetals.com/data/Ni-Co/allloy617.htm.*
(Continued)

*Primary Examiner* — Gregory Huson
*Assistant Examiner* — Martha Becton

(57) ABSTRACT

A burner carrier flange and a burner with such a burner carrier flange are provided. A surface of the burner carrier flange potentially comes into contact with fuel. The burner carrier element includes a base material and a corrosion-resistant material and the surface that potentially comes into contact with fuel is made of the corrosion-resistant material.

19 Claims, 4 Drawing Sheets

(51) Int. Cl.
*F01D 25/00* (2006.01)
*F23C 5/02* (2006.01)

(56) References Cited

U.S. PATENT DOCUMENTS

| | | | | |
|---|---|---|---|---|
| 3,620,205 | A * | 11/1971 | Vial | 126/110 E |
| 3,786,274 | A * | 1/1974 | Saponara | 307/117 |
| 4,081,235 | A * | 3/1978 | van der Veer | 431/54 |
| 4,322,945 | A * | 4/1982 | Peterson et al. | 60/800 |
| 4,497,625 | A * | 2/1985 | Petersen et al. | 431/208 |
| 4,622,946 | A * | 11/1986 | Hurley et al. | 126/39 E |
| 4,629,415 | A * | 12/1986 | DeWerth et al. | 431/347 |
| 4,633,029 | A * | 12/1986 | Tillett et al. | 136/205 |
| 4,634,481 | A * | 1/1987 | Petersen et al. | 156/89.15 |
| 5,178,921 | A | 1/1993 | Whelan | |
| 5,253,810 | A | 10/1993 | Maltby | |
| 5,941,459 | A * | 8/1999 | Brooker et al. | 239/397.5 |
| 6,228,224 | B1 * | 5/2001 | Brooker | 202/224 |
| 6,358,041 | B1 * | 3/2002 | Whittaker et al. | 431/160 |
| 6,520,481 | B2 * | 2/2003 | Harneit | 251/207 |
| 6,557,501 | B2 * | 5/2003 | Hughes | 122/13.01 |
| 6,883,730 | B2 * | 4/2005 | Eberspach et al. | 239/403 |
| 6,899,290 | B2 * | 5/2005 | Varble et al. | 239/533.12 |
| 7,168,949 | B2 * | 1/2007 | Zinn et al. | 431/350 |
| 8,302,544 | B2 * | 11/2012 | Takashima et al. | 110/104 B |
| 8,733,106 | B2 * | 5/2014 | Barker et al. | 60/747 |
| 2003/0196576 | A1 * | 10/2003 | Whittaker et al. | 110/260 |
| 2003/0197071 | A1 | 10/2003 | Whittaker | |
| 2004/0079083 | A1 * | 4/2004 | Stumpf et al. | 60/752 |
| 2004/0089701 | A1 * | 5/2004 | Tezuka | 228/233.2 |
| 2006/0246387 | A1 * | 11/2006 | Smirnov | 431/181 |
| 2007/0042306 | A1 * | 2/2007 | Bacon | 431/268 |
| 2007/0148478 | A1 * | 6/2007 | Schmitz et al. | 428/469 |
| 2007/0274876 | A1 | 11/2007 | Chiu | |
| 2008/0268389 | A1 * | 10/2008 | Nordh | 431/215 |
| 2009/0277177 | A1 * | 11/2009 | Hessler | 60/740 |
| 2009/0293253 | A1 * | 12/2009 | Walker | 29/402.13 |
| 2010/0154689 | A1 * | 6/2010 | Adam et al. | 110/265 |
| 2010/0199674 | A1 * | 8/2010 | Widener et al. | 60/737 |
| 2010/0285415 | A1 * | 11/2010 | Bottcher et al. | 431/159 |
| 2011/0117377 | A1 * | 5/2011 | Krusch et al. | 428/457 |
| 2011/0126509 | A1 * | 6/2011 | Headland et al. | 60/39.826 |

FOREIGN PATENT DOCUMENTS

| | | | |
|---|---|---|---|
| RU | 2289 | U1 | 6/1996 |
| RU | 2079787 | C1 | 5/1997 |

OTHER PUBLICATIONS

ICE Iron and Steel 16Mo3 Spec Sheet www.ice-steels.com/.*

* cited by examiner

BURNING ELEMENT AND BURNER WITH A CORROSION-RESISTANT INSERT

CROSS REFERENCE TO RELATED APPLICATIONS

This application is the US National Stage of International Application No. PCT/EP2009/051432 filed Feb. 9, 2009, and claims the benefit thereof. The International Application claims the benefits of European Patent Application No. 08002769.1 EP filed Feb. 14, 2008. All of the applications are incorporated by reference herein in their entirety.

FIELD OF INVENTION

The present invention relates to a burner element and a burner which are equipped with a corrosion-resistant insert.

BACKGROUND OF INVENTION

Internally, particular parts of a burner typically come into contact with fuel. The chemical reaction of sulfur compounds ($H_2S$) contained in the fuel with the base metal of the burner may cause iron sulfide scale to form inside the burner. The base metal of the burner is typically steel, e.g. 16Mo3 steel. The iron sulfide scale forming inside the burner may flake off and in some cases cause plugging of the holes through which the fuel is injected into a combustion chamber. The holes through which the fuel is injected into the combustion chamber are typically 1.5 mm in diameter. Plugging of said holes results in uneven combustion, thereby considerably worsening in particular the emission values of the burner in question. The availability of the burner affected or more specifically the associated combustion chamber is impaired in this case.

The problem of possible plugging of the holes as a result of flaking iron sulfide scale has hitherto been solved either by cleaning the burner or installing a new burner. However, cleaning is very time-consuming. In such cases, therefore, a complete set of new burners generally has to be installed which is very expensive. Although the problems described only occur on machines which are operated with pre-heating, these machines are being increasingly used. High additional costs resulting from the possible formation of iron sulfide scale are therefore to be expected.

In addition, the formation of in particular iron sulfide scale can be reduced by using corrosion-resistant materials such as IN617. However, these materials are much more expensive than the 16Mo3 steel used hitherto.

SUMMARY OF INVENTION

An object of the invention is to provide an advantageous burner element. Another object of the present invention is to provide an advantageous burner.

The objects are achieved by a burner element and a burner as claimed in the independent claims. The dependent claims contain further advantageous embodiments of the invention.

The burner element according to the invention comprises a surface which potentially comes into contact with a fuel. The burner element also comprises a base metal and a corrosion-resistant material, the surface potentially coming into contact with a fuel being made of said corrosion-resistant material. This prevents the formation of deposits, in particular of iron sulfide scale, on the surface potentially coming into contact with a fuel, thus ensuring compliance with emission limit values. It also enables the costs of cleaning or installing a new burner to be saved.

The base metal can be e.g. steel, in particular 16Mo3 steel. The corrosion-resistant material can be e.g. IN617. As it is only the surface potentially coming into contact with a fuel that is made of the corrosion-resistant and expensive material IN617, considerable cost savings can be made compared to a burner element made entirely from a corrosion-resistant material such as IN617.

The burner element according to the invention is implemented, for example, as a burner carrier flange. Furthermore, the burner carrier flange according to the invention comprises a base body comprising the base metal and an insert comprising the corrosion-resistant material.

In addition, the insert can comprise an outer surface and at least one opening. The base body can have an opening with an inner surface. In this case the insert can be disposed in the opening of the base body such that the inner surface of the opening of the base body is tightly connected to the outer surface of the insert. The insert can be e.g. welded into the base body.

In addition, the opening of the base body can be disposed eccentrically in the base body with respect to a central axis of the base body. Also the opening of the insert can be disposed eccentrically in the insert with respect to a central axis of the insert. The opening of the base body and/or the opening of the insert can have e.g. a circular cross section.

Using the burner carrier flange according to the invention, the fuel used can flow through the opening of the insert. As the insert is made of corrosion-resistant material, the fuel does not come into contact with the base metal, thereby preventing scale formation.

The burner according to the invention comprises an inventive burner element as described above. Said burner can be, for example, a pilot burner. The pilot burner can comprise, for example, nozzle holes one millimeter in diameter. The burner according to the invention basically has the same advantages as the described burner element according to the invention. With the aid of the present invention, the formation of deposits, in particular of iron sulfide scale, inside a burner can be inexpensively and effectively prevented. In addition, the present invention improves the emission values of the burner.

BRIEF DESCRIPTION OF THE DRAWINGS

Further properties, features and advantages of the present invention will now be described in greater detail on the basis of an exemplary embodiment and with reference to the accompanying drawings in which.

DETAILED DESCRIPTION OF INVENTION

Figure 1:
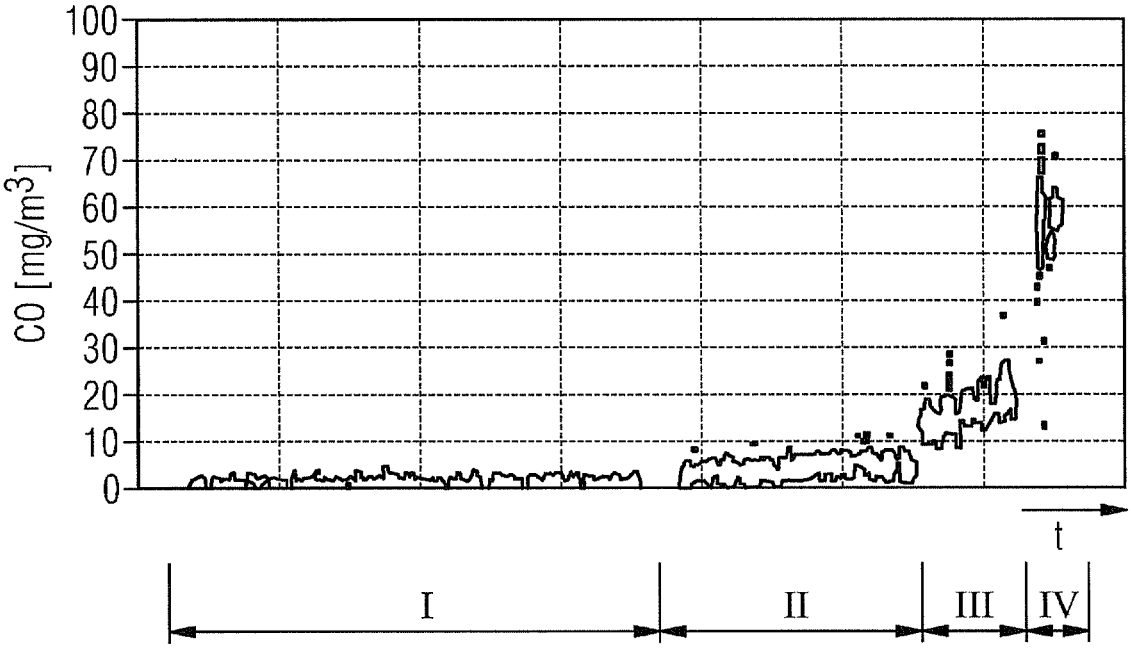
FIG. 1 shows the CO emission values of a conventional burner as a function of the operating time.

An exemplary embodiment of the present invention will now be explained in greater detail with reference to FIGS. 1 to 6. FIG. 1 shows the CO emission values of a conventional burner as a function of the operating time. Plotted on the x-axis of the graph shown in FIG. 1 is the date of the CO emission measurement. Plotted on the y-axis are the measured CO emission values in milligrams per cubic meter.

The graph shows the CO emission values for the burner in question over a period of time, subdivided into four sections I, II, III, IV. After a longer operating section I with extremely low emission values, the latter increased continuously in the second section II, but were mainly below 10 mg/m$^3$. In the subsequent time section III, the CO emission values increased more strongly than in section II and were mainly between 10 and 30 mg/m$^3$. In the fourth time section IV, CO emission values mainly between 40 and 80 mg/m$^3$ were measured.

The measurement shown in FIG. 1 shows that increased plugging of the burner due to the formation of iron sulfide scale goes hand in hand with a considerable deterioration in the CO emission values. The burner used by way of example is a gas turbine burner.

Figure 2:
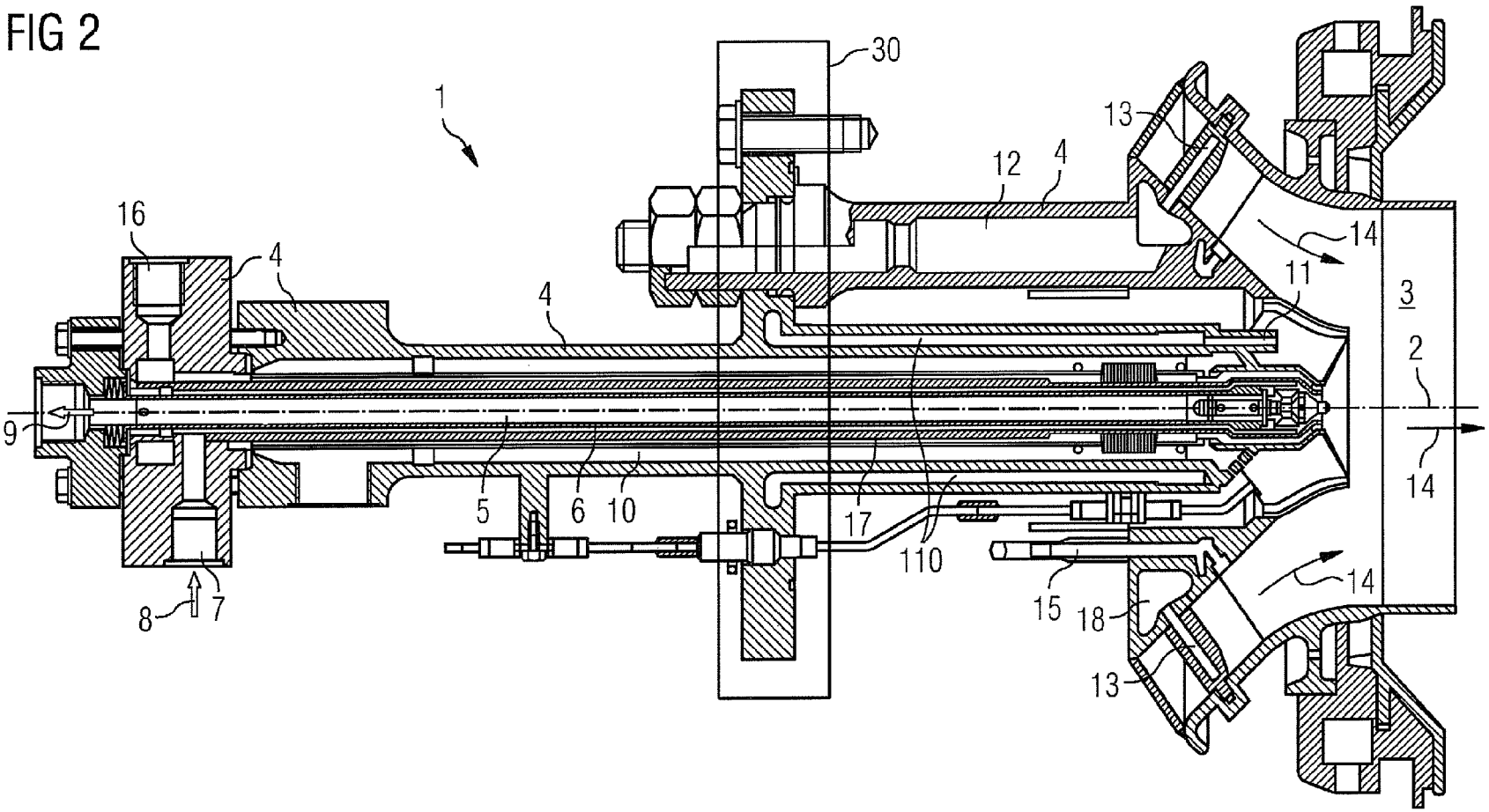
FIG. 2 schematically shows a section through an HR3B type burner which can be operated in mixed mode.

The design of a burner such as can be used e.g. as part of a gas turbine will now be explained in greater detail with reference to FIG. 2 which schematically shows a section through a burner 1 according to the invention. The burner 1 is connected to a combustion chamber 3. The central axis of the burner 1 is denoted by reference character 2.

The burner 1 comprises a housing 4. Inside said housing 4, a fuel oil return line 5 is disposed along the central axis 2. Disposed concentrically around said fuel oil return line 5 is a fuel oil feed line 6 which likewise runs along the central axis 2. There can also be a plurality of fuel oil feed lines 6 disposed concentrically around the fuel oil return line 5. On the side facing away from the combustion chamber 3, the fuel oil feed line 6 is connected to a connecting pipe 7 which can be connected to a fuel oil supply. The flow direction of the fuel oil is indicated by the arrows 8 and 9. The fuel oil can initially flow through the connecting pipe 7 into the fuel oil feed line 6. The fuel oil can flow through said fuel oil feed line 6 parallel to the central axis 2 in the direction of the combustion chamber 3 and be injected into said combustion chamber 3. Excess fuel oil can flow away from the combustion chamber 3 through the fuel oil return line 5 in a direction parallel to the central axis 2 as indicated by the arrow 9.

Along the central axis 2, one or more water lines 17 are disposed radially with respect to the central axis 2 outside the fuel oil return line 5 and the fuel oil feed line 6. The water line or lines 17 are connected to a water feed 16 on the side of the burner 1 facing away from the combustion chamber 3.

Fuel gas diffusion lines 10, 110 are disposed concentrically around the fuel oil return line 5, the fuel oil feed line 6 and the water lines 17. The fuel gas can be forwarded in the fuel gas diffusion lines 10, 110 to fuel nozzles 11. The fuel nozzles 11 are likewise disposed concentrically around the central axis 2 and enable the fuel to be injected into the combustion chamber 3.

Disposed radially with respect to the central axis 2 outside the fuel gas diffusion lines 10, 110 is a fuel gas pre-mixing supply line 12 through which the fuel gas can be fed to further fuel nozzles 13 via an annular distributor 18 disposed annularly around the central axis 2. The fuel can be injected into the combustion chamber 3 through the fuel nozzles 13. The flow direction of the fuel/air mixture in the combustion chamber 3 is indicated by arrows 14.

Reference character 30 indicates the position of the burner carrier flange. In particular the distribution of the fuel gas to the fuel gas diffusion lines 110 takes place in the burner carrier flange 30. The fuel gas diffusion lines 110 are implemented as pipes leading to the combustion chamber 3.

The inner surfaces of the burner carrier flange 30 are in direct contact with the fuel gas flowing through them. Because of the chemical reaction of sulfur compounds contained in the fuel gas with the base metal of these components, iron sulfide scale may form on the inner surfaces of the burner carrier flange 30. This scale can flake off, resulting in partial plugging of the fuel nozzles 11, 13.

Figure 3:
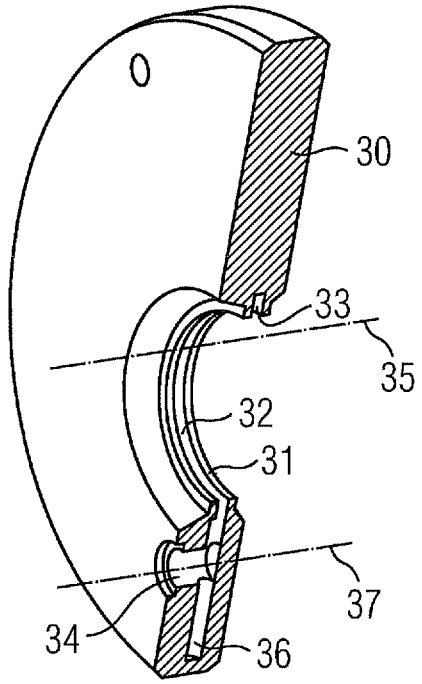
FIG. 3 schematically shows a partially perspective view of a section through a conventional burner carrier flange.

FIG. 3 schematically illustrates a section through a conventional burner carrier flange 30 in a partly perspective view. The burner carrier flange 30 can in particular be made of 16Mo3 steel. The conventional burner carrier flange 30 shown by way of example in FIG. 3 comprises a through-going opening 31 through which the fuel oil return line 5, the fuel oil feed line 6, the water lines 17 and the fuel gas diffusion line 10 pass. The burner carrier flange 30 also comprises other through-going openings and screw connections which, however, are not shown in FIG. 3. The opening 31 is of circular cross section. In addition, the opening 31 is disposed eccentrically with respect to a central axis 35 of the burner carrier flange 30.

The inner surface 32 of the opening 31 contains a groove 33 running along the circumference of the opening 31 and through which the fuel gas is conveyed to the fuel gas diffusion lines 110. The burner carrier flange 30 also contains a flow duct 36 which runs perpendicular to the central axis 35 and is fluidically connected to the groove 33. The flow duct 36 is also connected to an opening 34 which is disposed radially outside the opening 31 with respect to the central axis 35. Fuel gas can be fed into the groove 33 through the opening 34. The opening 34 has a central axis 37 which runs parallel to the central axis 35 of the burner carrier flange 30. The opening 34 has a smaller diameter than the opening 31.

The opening 31 also has an inner surface 32 which typically comes into contact with a fuel. This can be in particular the surface of the groove 33. Deposits such as iron sulfide scale can form on said inner surface 32 as the result of contact with the fuel.

Figure 4:
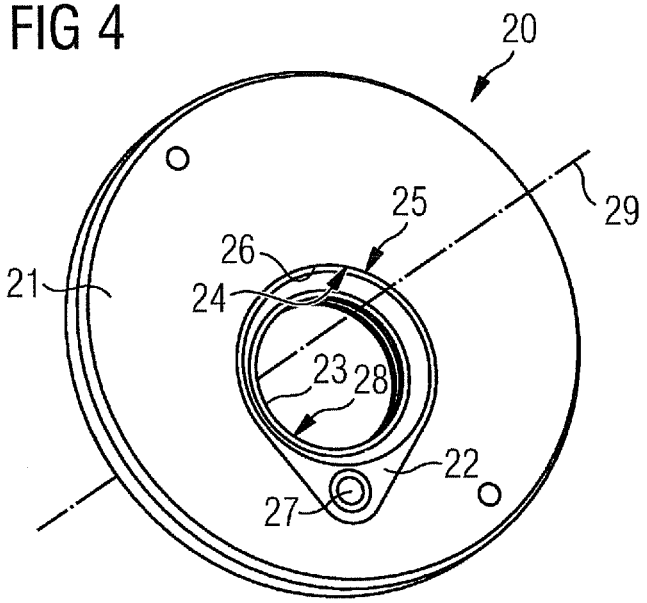
FIG. 4 schematically shows a perspective view of a burner carrier flange according to the invention.

FIG. 4 schematically shows a perspective view of the burner carrier flange 20 according to the invention. The burner carrier flange according to the invention 20 comprises a base body 21 and an insert 22. The base body consists, for example, of 16Mo3 steel. The insert 22 consists of a corrosion-resistant material such as IN617.

The base body 21 has a circular cross section with a central axis 29. It also comprises a through-going opening 26 which is disposed eccentrically with respect to the central axis 29. The opening 26 has a drop-shaped cross section. The inner surface of the opening 26 is denoted by the reference character 24.

The insert 22 comprises an outer surface 25 which is designed such that the insert 22 can be inserted in the opening 26 of the base body 21 such that the inner surface 24 of the base body 21 is tightly connected to the outer surface 25 of the insert 22.

The insert 22 also comprises a through-going opening 23 which has a circular cross section and is disposed eccentrically with respect to the central axis 29. The inner surface of the opening 23 potentially coming into contact with a fuel is denoted by the reference character 28. The insert 22 also comprises an opening 27 which has the same characteristics as the opening 34 of the conventional burner carrier flange 30 described in connection with FIG. 3.

The variant shown in FIG. 4 is characterized in that, although it requires relatively little corrosion-resistant material, it is expensive to manufacture because of the symmetrical, drop-shaped cross section of the opening 26 and outer surface 25 of the insert 22.

Figure 5:
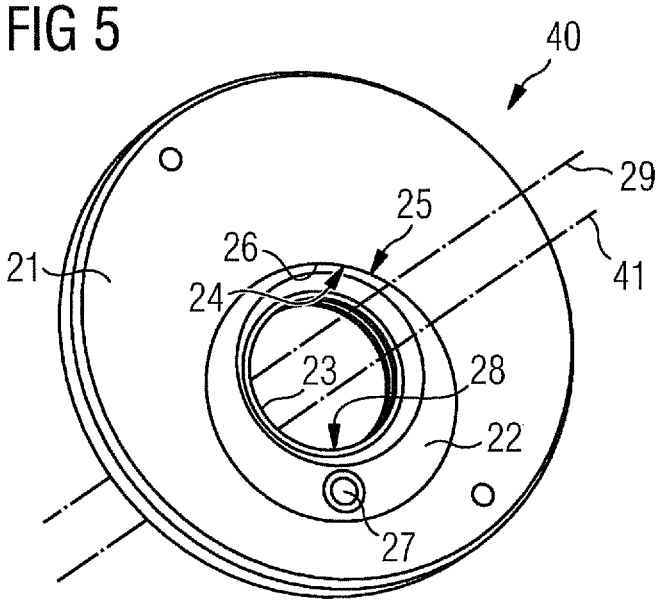
FIG. 5 schematically shows a perspective view of an alternative burner carrier flange according to the invention.

FIG. 5 shows a perspective view of another variant of a burner carrier flange 40 according to the invention. Unlike the burner carrier flange 20 shown in FIG. 4, the inventive burner carrier flange 40 is characterized in that the opening 26 of the base body 21 and the insert 22 have a circular cross section. The insert 22 comprises a central axis 41 which runs parallel to the central axis 29 of the burner carrier flange 40. The insert 22 is again disposed eccentrically with respect to the central axis 29 of the burner carrier flange 40.

Inside the insert 22, the opening 23, which again has a circular cross section, is disposed eccentrically with respect to the central axis 41 of the insert 22. The other elements indicated in FIG. 5 correspond to the elements described in connection with FIG. 4.

Figure 6:
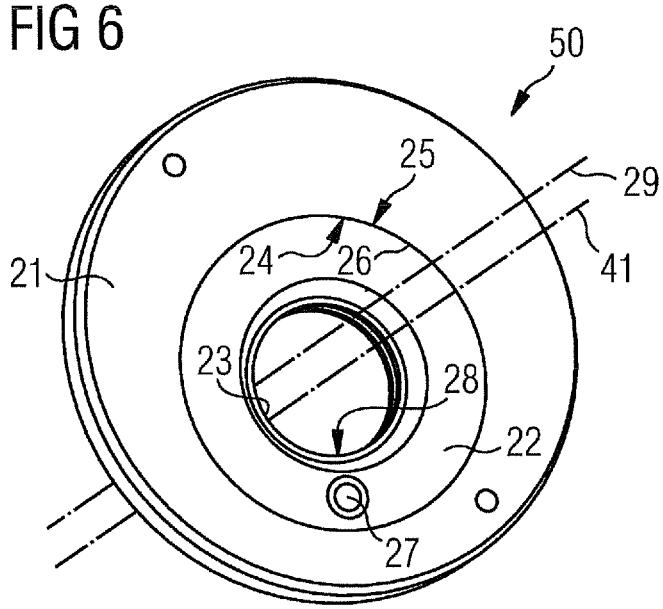
FIG. 6 schematically shows a perspective view of another burner carrier flange according to the invention.

Another variant of the inventive burner flange 50 is shown schematically in FIG. 6 in a perspective view. In contrast to the burner carrier flange 40 shown in FIG. 5, the burner carrier flange 50 shown in FIG. 6 is characterized in that the opening 23 of the insert 22 is disposed concentrically with respect to the central axis 41 of the insert 22. The burner carrier flange 50 otherwise has the same features and properties as the burner carrier flange 40 shown in FIG. 5. Compared to the variant shown in FIG. 4, the variants shown in FIGS. 5 and 6 are characterized in that, although more corrosion-resistant, expensive material is required, manufacturing is simpler and less expensive because of the circular cross section of the opening 26 of the base body 21 and the outer surface 25 of the insert 22. The embodiment shown in FIG. 6 is the preferred variant.

By splitting the inventive burner carrier flange 20, 40, 50 into two in the form, of a base body 21 and an insert 22 which consist of different materials, the problem of scale formation can be inexpensively solved. In particular, the part of the burner carrier flange 20, 40, 50 potentially coming into contact with a fuel and therefore at risk of such scaling is made of a corrosion-resistant material such as IN617, and the remaining part, i.e. the base body 21, is made of an inexpensive material such as 16Mo3 steel.

The invention claimed is:

1. A burner carrier flange, comprising:

a base body comprising a base metal of a first material, the base body not in contact with a fluid path for a fuel; and an insert comprising a second material different from the first material and more corrosion-resistant than the first material, the insert in contact with a fluid path for a fuel, wherein the insert comprises an outer surface and a first opening, wherein the base body comprises a second opening with an inner surface, and wherein the insert is disposed in the second opening of the base body, wherein the insert is connected to the base body through the second opening of the base body such that the inner surface of the second opening is connected in a closed manner to the outer surface of the insert, and wherein the insert comprises a third opening disposed radially outward of the first opening for feeding a fuel gas into a circumferential groove of the insert.

2. The burner carrier flange as claimed in claim 1, wherein the base metal is steel.

3. The burner carrier flange as claimed in claim 2, wherein the base metal is 16Mo3 steel.

4. The burner carrier flange as claimed in claim 1, wherein the corrosion-resistant material is IN617.

5. The burner carrier flange as claimed in claim 3, wherein the corrosion-resistant material is IN617.

6. The burner carrier flange as claimed in claim 1, wherein the second opening is disposed eccentrically in the base body with respect to a central axis of the base body.

7. The burner carrier flange as claimed in claim 1, wherein the first opening is disposed eccentrically in the insert with respect to a central axis of the insert.

8. The burner carrier flange as claimed in claim 1, wherein the second opening of the base body or the first opening of the insert has a circular cross section.

9. The burner carrier flange as claimed in claim 1, wherein the second opening of the base body and the first opening of the insert have circular cross sections.

10. A burner, comprising:

a burner carrier flange, the burner carrier flange comprising:

a base body comprising a base metal of a first material, the base body not in contact with a fluid path for a fuel; and an insert comprising a second material different from the first material and more corrosion-resistant than the first material, the insert in contact with a fluid path for a fuel, wherein the insert comprises an outer surface and a first opening, wherein the base body comprises a second opening with an inner surface, and wherein the insert is disposed in the second opening of the base body, wherein the insert is connected to the base body through the second opening of the base body such that the inner surface of the second opening is connected in a closed manner to the outer surface of the insert, and wherein the insert comprises a third opening disposed radially outward of the first opening for feeding a fuel gas into a circumferential groove of the insert.

11. The burner as claimed in claim 10, wherein the base metal is steel.

12. The burner as claimed in claim 11, wherein the base metal is 16Mo3 steel.

13. The burner as claimed in claim 10, wherein the corrosion-resistant material is IN617.

14. The burner as claimed in claim 12, wherein the corrosion-resistant material is IN617.

15. The burner as claimed in claim 10, wherein the second opening is disposed eccentrically in the base body with respect to a central axis of the base body.

16. The burner as claimed in claim 10, wherein the first opening is disposed eccentrically in the insert with respect to a central axis of the insert.

17. The burner as claimed in claim 10, wherein the second opening of the base body or the first opening of the insert has a circular cross section.

18. The burner as claimed in claim 10, wherein the second opening of the base body and the first opening of the insert have circular cross sections.

19. The burner as claimed in claim 10, wherein the burner is a pilot burner.

* * * * *